US008034518B2

(12) United States Patent
Coggan et al.

(10) Patent No.: US 8,034,518 B2
(45) Date of Patent: Oct. 11, 2011

(54) PHOTORECEPTOR

(75) Inventors: Jennifer A. Coggan, Cambridge (CA); Matthew A. Heuft, Oakville (CA); Gregory McGuire, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 777 days.

(21) Appl. No.: 11/828,582

(22) Filed: Jul. 26, 2007

(65) Prior Publication Data

US 2009/0029276 A1 Jan. 29, 2009

(51) Int. Cl.
*G03G 15/02* (2006.01)

(52) U.S. Cl. ..... 430/58.05; 430/127

(58) Field of Classification Search ..... 430/58.05, 430/127; 399/159
See application file for complete search history.

(56) References Cited

U.S. PATENT DOCUMENTS

| | | | |
|---|---|---|---|
| 3,121,066 | A | 2/1964 | Horst |
| 4,050,935 | A | 9/1977 | Limburg et al. |
| 4,281,054 | A | 7/1981 | Horgan et al. |
| 4,297,425 | A | 10/1981 | Pai et al. |
| 4,298,697 | A | 11/1981 | Baczek et al. |
| 4,338,390 | A | 7/1982 | Lu |
| 4,415,640 | A | 11/1983 | Goto et al. |
| 4,560,635 | A | 12/1985 | Hoffend et al. |
| 4,599,286 | A | 7/1986 | Limburg et al. |
| 5,336,577 | A | 8/1994 | Spiewak et al. |
| 5,681,679 | A | 10/1997 | Schank et al. |
| 5,702,854 | A | 12/1997 | Schank et al. |
| 5,976,744 | A | 11/1999 | Fuller et al. |

FOREIGN PATENT DOCUMENTS

| | | |
|---|---|---|
| JP | A-64-74551 | 3/1989 |
| JP | 5-323635 | * 12/1993 |

OTHER PUBLICATIONS

Song et al., "A Cyclic Triphenylamine Dimer for Organic Field-Effect Transistors with High Performance," *J. Am. Chem. Soc.*, vol. 128, No. 50, pp. 15940-15941 (2006).

Wang et al., "Symmetric and Asymmetric Charge Transfer Process of Two-Photon Absorbing Chromophores: Bis-Donor Substituted Stilbenes, and Substituted Styrylquinolinium and Styrylpyridinium Derivatives," *Journal of Materials Chemistry*, vol. 11, pp. 1600-1605 (2001).

* cited by examiner

*Primary Examiner* — Thorl Chea
(74) *Attorney, Agent, or Firm* — Oliff & Berridge, PLC

(57) ABSTRACT

An electrophotographic imaging member includes a substrate, a photo generating layer, and an optional overcoating layer, wherein the photo generating layer includes a cyclic triphenylamine derivative material.

15 Claims, No Drawings

PHOTORECEPTOR

TECHNICAL FIELD

This disclosure is generally directed to electrophotographic imaging members and, more specifically, to layered photoreceptor structures comprising a charge transport layer that comprises cyclic triphenylamine derivatives as charge transport materials. This disclosure also relates to processes for making and using the imaging members.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,415,640 discloses a single layered charge generating/charge transporting light sensitive device. Hydrazone compounds, such as unsubstituted fluorenone hydrazone, may be used as a carrier-transport material mixed with a carrier-generating material to make a two-phase composition light sensitive layer. The hydrazone compounds are hole transporting materials but do not transport electrons.

U.S. Pat. No. 5,336,577 discloses an ambipolar photoresponsive device comprising: a supporting substrate; and a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidine containing polymer.

The disclosures of each of the foregoing patents and applications are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogenous layer of a single material vitreous selenium or it may be a composite layer containing a photoconductor and other materials. In addition, the imaging member may be layered in which each layer making up the member performs a certain function. Certain layered organic imaging members generally have at least a substrate layer and two electro or photoactive layers. These active layers generally include (1) a charge generating layer containing a light-absorbing material, and (2) a charge transport layer containing charge transport molecules or materials. These layers can be in a variety of orders to make up a functional device, and sometimes can be combined in a single or mixed layer. The substrate layer may be formed from a conductive material. Alternatively, a conductive layer can be formed on a non-conductive inert substrate by a technique such as but not limited to sputter coating.

The charge generating layer is capable of photo generating charge and injecting the photo generated charge into the charge transport layer or other layer.

In the charge transport layer, the charge transport molecules may be in a polymer binder. In this case, the charge transport molecules provide whole or electron transport properties, while the electrically inactive polymer binder provides mechanical properties. Alternatively, the charge transport layer can be made from a charge transporting polymer such as a vinyl polymer, polysilylene or polyether carbonate, wherein the charge transport properties are chemically incorporated into the mechanically robust polymer.

Imaging members may also include a charge blocking layer(s) and/or an adhesive layer(s) between the charge generating layer and the conductive substrate layer. In addition, imaging members may contain protective overcoatings. These protective overcoatings can be either electroactive or inactive, where electroactive overcoatings are generally preferred. Further, imaging members may include layers to provide special functions such as incoherent reflection of laser light, dot patterns and/or pictorial imaging or subbing layers to provide chemical sealing and/or a smooth coating surface.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer.

Although excellent toner images may be obtained with multi-layered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of photoreceptor manufacturing, and thus on the manufacturing yield.

Despite the various approaches that have been taken for forming imaging members there remains a need for improved imaging member design, to provide improved imaging performance, longer lifetime, and the like.

Song et al., *A Cyclic Triphenylamine Dimer for Organic Field-Effect Transistors with High Performance*, J. Arm. Chem. Soc., Vol. 128, No. 50, 2006, pages 15940-15941, describes the use of the below compound 1 for organic field-effect transistors ("OFETs") with high mobility. Compound 1 was prepared in two steps from triphenylamine through the use of a Vilsmeier reaction followed by McMurry coupling (scheme 1). It was stated that this material has large solubility in common organic solvents such as dichloromethane, chloroform, and toluene. In the OFET devices, the hole mobility of one was found to be $1.5\times10^{-2}\ cm^2\ V^{-1}\ s^{-1}$, which was a 100 times higher than the mobility of the below compound 2 under the same conditions.

1

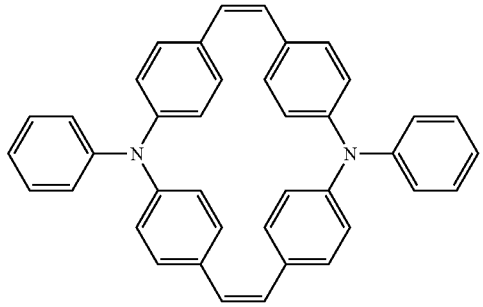

2

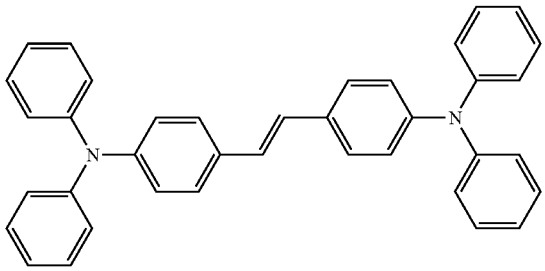

Scheme 1: The synthesis of a cyclic triphenylamine derivative

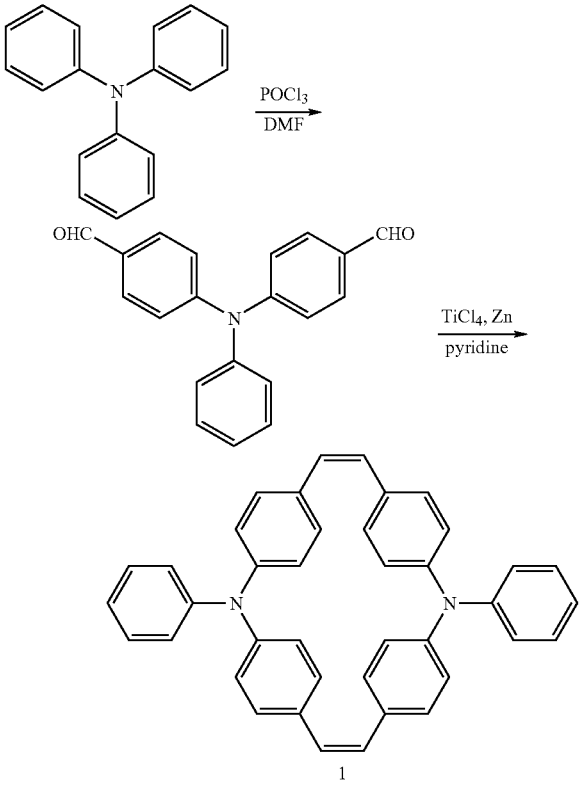

SUMMARY

This disclosure addresses some or all of the above problems, and others, by providing imaging members where the charge transport layer includes a cyclic triphenylamine derivative material as a charge transport material.

This disclosure also provides materials and methods for improved hole mobility in the electrophotographic photoreceptors. This is generally accomplished by using cyclic triphenylamine derivative materials as a charge transport material in the charge transport layer of the photoreceptor.

As electrographic machines such as printers and copiers require an ever greater increase in machine speed, the photoreceptor must also continue to increase its ability to move charge and keep up. By some estimations, using the current best practice organic photoreceptor technology, the photoreceptor moves charge across its structure in roughly the same amount of time there would be between the expose and development stations in machines approaching a speed of 200 ppm. There is thus a need, addressed in embodiments, to increase the speed of which a photoreceptor can discharge in order to gain latitude below 200 ppm or in order to penetrate the 200 ppm level. One approach for solving this problem is to use a high mobility charge transport material for the charge transport layer of the photoreceptor.

In an embodiment, the present disclosure provides an electrophotographic imaging member comprising:

a substrate, a photo generating layer, and an optional overcoating layer, wherein the photo generating layer comprises a cyclic triphenylamine derivative material.

In another embodiment, the present disclosure provides a process for forming an electrophotographic imaging member comprising:

providing an electrophotographic imaging member substrate, and applying a photogenerating layer over the substrate, wherein the photo generating layer comprises a cyclic triphenylamine derivative material.

The present disclosure also provides electrophotographic image development devices comprising such electrophotographic imaging members. Also provided are imaging processes using such electrophotographic imaging members.

EMBODIMENTS

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer is formed on the adhesive layer, blocking layer or substrate. The electrophotographic imaging layer may be a single layer that performs both charge generating and hole or charge transport functions as is known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyamine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also be fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer comprises a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N'-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. Small molecule charge transporting compounds that permit injection of holes from the pigment into the charge generating layer with high efficiency and transport them across the charge transport layer with very short transit times are N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine. If desired, the charge transport material in the charge transport layer may comprise a polymeric charge transport material or a combination of a small molecule charge transport material and a polymeric charge transport material.

Although the various charge transporting compounds provide very short transit times in the photoreceptors, even faster transit times are needed in order to provide faster cycle times and faster printing speeds. Charge mobility or transit time in the charge transport layer can become a rate-limiting factor in machine design, and thus, material changes are one approach for increasing the cycle rate of the photoreceptor. In embodiments, different charge transport materials are thus needed to increase the charge mobility and thus increase the allowable cycle rate.

The charge transport layer in embodiments, thus further comprises, either in addition to or in place of the above-described charge transport materials, cyclic triphenylamine derivative materials dissolved or molecularly dispersed in the film-forming binder. In an embodiment, the charge transport layer comprises the cyclic triphenylamine derivative materials, and is free or essentially free of other charge transport materials. In other embodiments, the cyclic triphenylamine derivative material can be used in combination with other conventional charge transport materials. As the cyclic triphenylamine derivative material, any of the currently known or after-developed cyclic triphenylamine derivative materials and variants can be used.

In embodiments, cyclic triphenylamine derivatives encompass compounds that include 2 or more triphenylamine molecules bonded together.

Specific examples of cyclic triphenylamine derivative include cyclic triphenylamine derivative of the following formula:

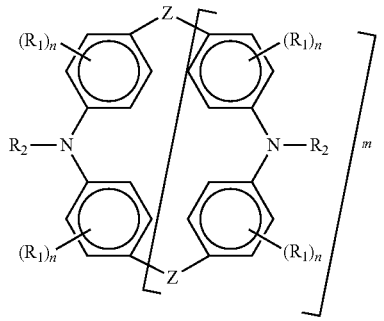

wherein each n independently represents 0, 1, 2, 3, or 4 and m represents 1 to 10.

Each $R_1$ and $R_2$ independently represents any suitable group including but not limited to a hydrogen atom, a halogen atom, a hydroxyl group, a substituted or unsubstituted amino group, nitro group or cyano group, a substituted or unsubstituted alkyl group, a substituted or unsubstituted alkenyl group, a substituted or unsubstituted cycloalkyl group, a substituted or unsubstituted alkoxy group, a substituted or unsubstituted aromatic hydrocarbon group, a substituted or unsubstituted aromatic heterocyclic group, a substituted or unsubstituted aralkyl group, a substituted or unsubstituted aryloxy group, or a substituted or unsubstituted alkoxycarbonyl or carboxyl group; wherein the alkyl group has from 1 to about 50 carbon atoms, the alkenyl group has from 1 to about 50 carbon atoms, the cycloalkyl group has from about 3 to about 50 carbon atoms, the alkoxy group has from 1 to about 50 carbon atoms, the aromatic hydrocarbon group has from about 6 to 50 carbon atoms, the aromatic heterocyclic group has about 4 to about 50 carbon atoms, the aryl alkyl group has about 6 to about 50 carbon atoms, the aryloxy group has 6 to 20 carbon atoms, and the alkoxycarbonyl or carboxyl group has 1 to 50 carbon atoms; wherein each group can be substituted with groups such as, for example, silyl groups; nitro groups; cyano groups; halide atoms, such as fluoride, chloride, bromide, iodide, and astatide; amine groups, including primary, secondary, and tertiary amines; hydroxy groups; alkoxy groups, such as having from 1 to about 20 carbon atoms such as from 1 to about 11 carbon atoms; aryloxy groups, such as having from about 6 to about 20 carbon atoms such as from about 6 to about 10 carbon atoms; alkylthio groups, such as having from 1 to about 20 carbon atoms such as from 1 to about 10 carbon atoms; arylthio groups, such as having from about 6 to about 20 carbon atoms such as from about 6 to about 10 carbon atoms; aldehyde groups; ketone groups; ester groups; amide groups; carboxylic acid groups; sulfonic acid groups; and the like.

Each Z independently represents any suitable group including but not limited to hydro-carbons, having from about 2 to about 10 carbon atoms such as alkyl and alkenyl groups wherein these groups can be substituted or unsubstituted, wherein the substitutions can be the same as the substitutions listed for $R_1$ and $R_2$.

Exemplary embodiments of the above compounds include, for example, those where each n is 0 or 1 and m is 1 or 2; each are $R_1$, when present, is an alkyl group of from 1 to about 3 carbon atoms; each are $R_2$, when present is a phenyl group, optionally substituted with one or two alkyl groups each having 1 to about 3 carbon atoms, or a naphthyl group; or z is —C═C— or —C—C—. In examples, particular embodiments of the above compounds include those where each n is 0, m is 1, each $R_2$ is 3,4-dimethylphenyl, or naphthyl, and z is —C═C— or —C—C—.

Further, in some embodiments, it is desired that the compounds be symmetrical, such as by being dimers or trimers of identical triphenylamine compounds. In these embodiments, for example, each n is the same, m can be 1 or 2, each $R_1$ is the same, and each $R_2$ is the same. Likewise, in embodiments, each Z linkage in the compound is also the same. Of course, in some embodiments, symmetry is not necessary or required.

Specific examples of cyclic triphenylamine derivatives include those of the formulae:

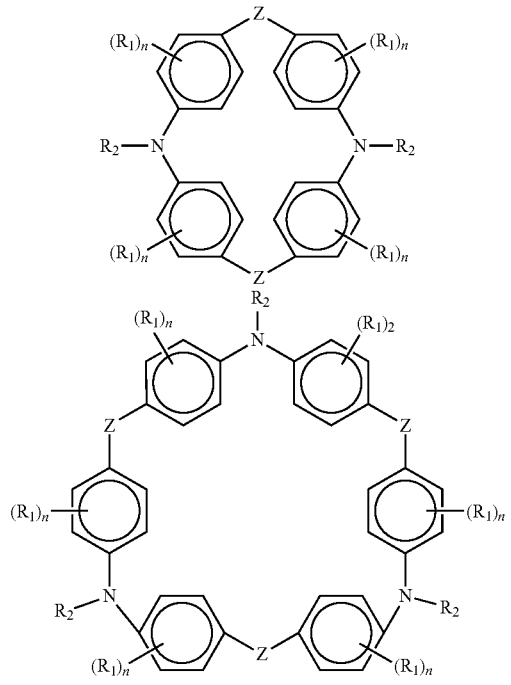

wherein each n independently represents 0, 1, 2, 3, or 4 and m represents 1 to 10.

Each $R_1$ and $R_2$ independently represents any suit able group including but not limited to a hydrogen atom, a halogen atom, a hydroxyl group, a substituted or unsubstituted amino group, nitro group or cyano group, a substituted or unsubstituted alkyl group, a substituted or unsubstituted alkenyl group, a substituted or unsubstituted cycloalkyl group, a substituted or unsubstituted alkoxy group, a substituted or unsubstituted aromatic hydrocarbon group, a substituted or unsubstituted aromatic heterocyclic group, a substituted or unsubstituted aralkyl group, a substituted or unsubstituted aryloxy group, or a substituted or unsubstituted alkoxycarbonyl or carboxyl group; wherein the alkyl group has from 1 to about 50 carbon atoms, the alkenyl group has from 1 to about 50 carbon atoms, the cycloalkyl group has from about 3 to about 50 carbon atoms, the alkoxy group has from 1 to about 50 carbon atoms, the aromatic hydrocarbon group has from about 6 to 50 carbon atoms, the aromatic heterocyclic group has about 4 to about 50 carbon atoms, the aryl alkyl group has about 6 to about 50 carbon atoms, the aryloxy group has 6 to 20 carbon atoms, and the alkoxycarbonyl or carboxyl group has 1 to 50 carbon atoms; wherein each group can be substituted with groups such as, for example, silyl groups; nitro groups; cyano groups; halide atoms, such as fluoride, chloride, bromide, iodide, and astatide; amine groups, including primary, secondary, and tertiary amines; hydroxy groups; alkoxy groups, such as having from 1 to about 20 carbon atoms such as from 1 to about 10 carbon atoms; aryloxy groups, such as having from about 6 to about 20 carbon atoms such as from about 6 to about 10 carbon atoms; alkylthio groups, such as having from 1 to about 20 carbon atoms such as from 1 to about 10 carbon atoms; arylthio groups, such as having from about 6 to about 20 carbon atoms such as from about 6 to about 10 carbon atoms; aldehyde groups; ketone groups; ester groups; amide groups; carboxylic acid groups; sulfonic acid groups; and the like.

Each Z independently represents any suitable group including but not limited to hydro-carbons, having from about 2 to about 10 carbon atoms such as alkyl and alkenyl groups wherein these groups can be substituted or unsubstituted, wherein the substitutions can be the same as the substitutions listed for $R_1$ and $R_2$.

Other specific examples of suitable compounds include those of the formulae:

(1)

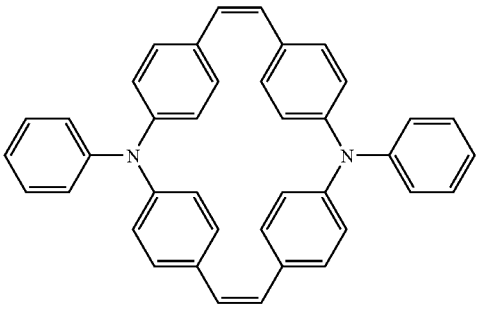

(2)

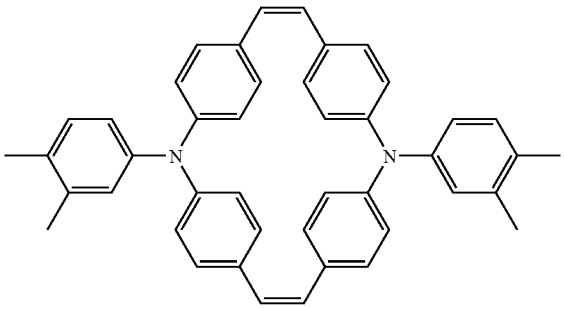

(3)

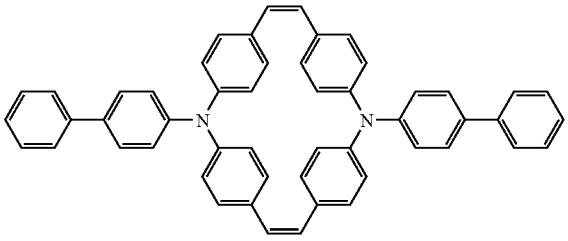

-continued (4)

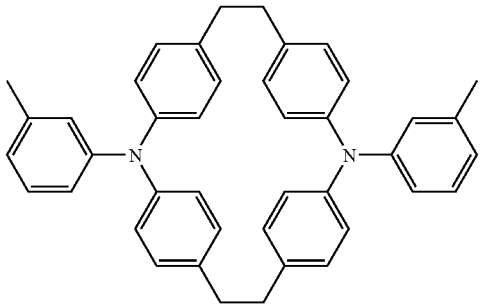

(5)

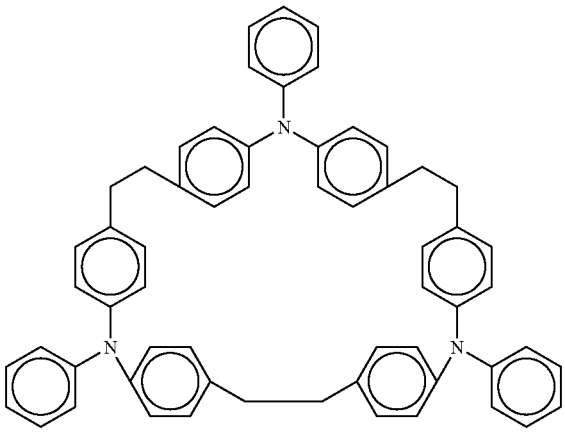

(6)

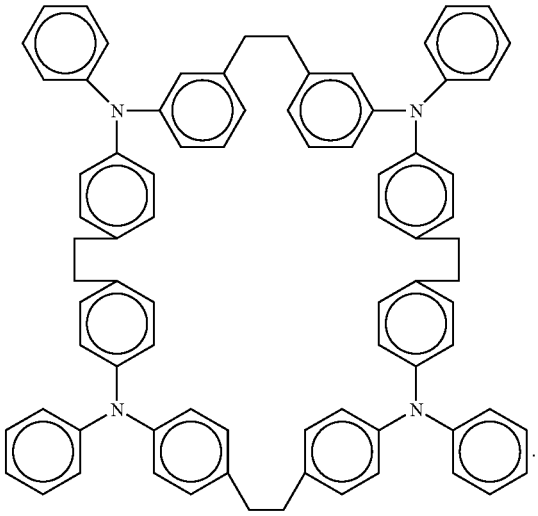

Any suitable and conventional technique may be utilized to synthesize cyclic triphenylamine derivatives. As one exemplary example, synthesis of cyclic triphenylamine derivatives can be prepared by undergoing the following steps: (1) Vilsmeier reaction, for example to provide reactive functional end groups, followed by (2) McMurry coupling to form the desired compound. This is shown in the following reaction:

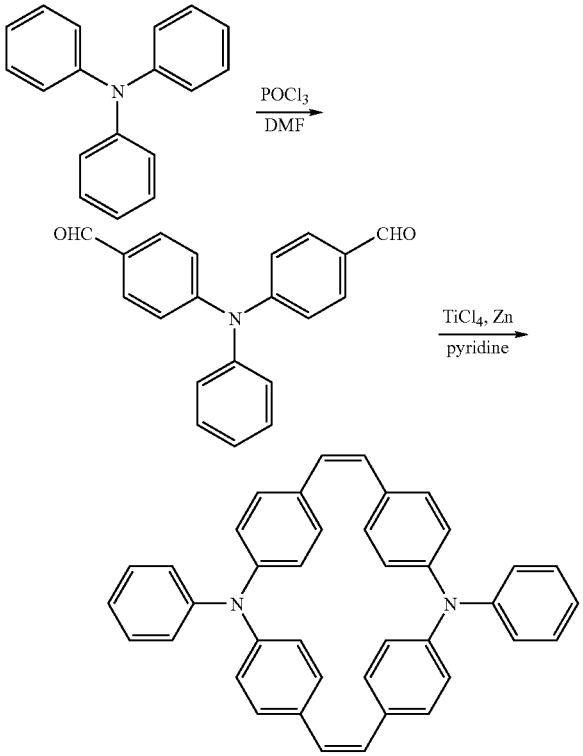

1

In addition, the cyclic triphenylamine derivative of the present disclosure can include cyclic triphenylamine derivatives wherein the ethylene linker is saturated or unsaturated and the triphenylamine portions are substituted or unsubstituted. Combinations of these saturated, unsaturated, substituted and unsubstituted cyclic triphenylamine derivatives are encompassed by the term "cyclic triphenylamine derivative materials" herein. In the embodiments, the cyclic triphenylamine derivative material is desirably free, or essentially free, of any catalyst material used to prepare the cyclic triphenylamine derivative.

In embodiments, the cyclic triphenylamine derivative materials can be incorporated into the charge transport layer in any desirable and effective amount. For example, a suitable loading amount can range from about 10 wt %, to as high as about 75 wt % or more. However, loading amounts of from about 35 wt % to about 55 wt % may be desired in some embodiments. Thus, for example, the charge transport layer in embodiments could comprise about 25 to about 90 percent by weight polymer binder, about 5 to about 75 percent by weight hole transport small molecule, and about 5 to about 75 percent by weight cyclic triphenylamine derivative material, although amounts outside these ranges could be used. Any suitable charge transporting molecule may be employed as a hole transport small molecule, including cyclic triphenylamine derivatives.

Further, the cyclic triphenylamine derivative materials exhibit a very high charge transport mobility. Accordingly, the use of cyclic triphenylamine derivative materials in a charge transport layer can provide charge transport speeds that are about 10 times higher than charge transport speeds provided by conventional charge transport materials. For example, the charge transport mobility in a charge transport layer comprising cyclic triphenylamine derivative materials can be 1 or more such as about 1 to about 2, orders of magnitude higher as compared to comparable charge transport layer that includes a similar amount of conventional pyrazoline, diamine, hydrazones, oxadiazole, or stilbene charge transport small molecules. This resultant dramatic increase in charge mobility can result in significant corresponding improvements in the printing process and apparatus, such as extreme printing speeds, increased print quality, and increased photoreceptor reliability.

Any suitable electrically inactive resin binder insoluble in the alcohol solvent used to apply an optional overcoat layer may be employed in the charge transport layer. Typical inactive resin binders include polycarbonate resin, polyester, polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidine-diphenylene)carbonate (referred to as bisphenol-Z polycarbonate), poly(4,4'-isopropylidene-3,3'-dimethyldiphenyl) carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layers is desirably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer. i.e., charge generation layer, and allows these holes to be transported through itself to selectively discharge a surface charge on the surface of the active layer.

To improve photoreceptor wear resistance, a protective overcoat layer can be provided over the photogenerating layer (or other underlying layer). Various overcoating layers are known in the art, and can be used as long as the functional properties of the photoreceptor are not adversely affected.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

The following examples are being submitted to illustrate embodiments of the present disclosure. These examples are intended to be illustrative only, and are not intended to limited the scope of the present disclosure. Comparative examples and data are also provided.

EXAMPLES

Cyclic triphenylamine derivatives can be prepared through the use of a Vilsmeier reaction followed by McMurry coupling and any other obvious reactions to those skilled in the art which would produce the desired compound.

Example 1

A cyclic triphenylamine derivative ("Compound 1") was prepared as described previously having the following structure and chemical formula:

1

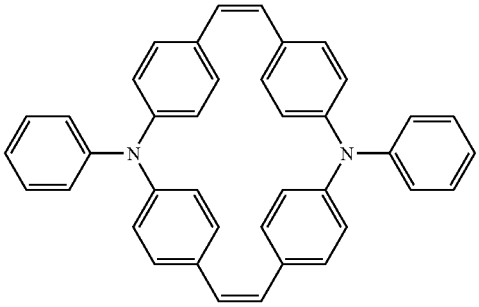

Comparative Example 1

Using conventional methods, the following charge transport material ("Compound 2") was prepared having the following structure and chemical formula:

2

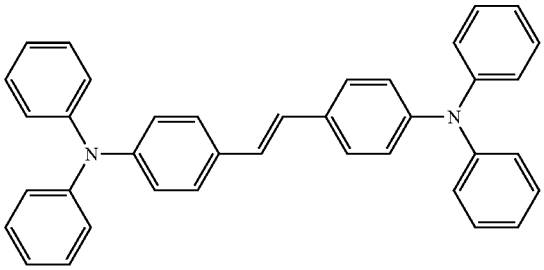

Compound 2 has been studied for use in photoreceptors [JP 01074551, date 20 Mar. 1989, Toshiba Corp.] and has been shown to perform adequately. The synthesis can be found in the paper by Wang et al., *Symmetric and asymmetric charge transfer process of two-photon absorbing chromophores: bis-donor substituted stilbenes, and substituted styrylquinolinium and styrylpyridinium derivatives*, Journal of Materials Chemistry, Vol. 11, 2001, pages 1600-1605. Compound 2 can be prepared through titanium-catalyzed reductive coupling of 4-(diphenylamino)benzaldehyde.

The cyclic triphenylamine derivative in Example 1 had a hole mobility about 100 times higher than Compound 2 under the same conditions in an OFET device.

Example 2

An imaging or photoconducting member incorporating cyclic triphenylamine derivative is prepared in accordance with the following procedure. A metallized mylar substrate is provided and a HOGaPc/poly(bisphenyl-carbonate) photo generating layer is machine coated over the substrate. The photo generating layer is overcoated with a charge transport layer prepared by introducing into an amber glass bottle 50 wt % of the cyclic triphenylamine derivative of compound 1, synthesized as discussed above, and 50 wt % of Macrolon 5705®, a known polycarbonate resin having an average molecular weight of from about 50,000 to about 100,000, commercially available from Farbenfabriken Bayer A.G. The resulting mixture is then dissolved in methylene chloride to form a solution containing 15% by weight solids. This solution is applied on the photogenerating layer to form a layer coating that upon drying (120° C. for 1 minute) has a thickness of 30 microns. During this coating process, the humidity is equal to or less than about 15%.

Comparative Example 2

A comparative photoconductor is prepared by repeating the process of Example 1 except that the charge transport layer is prepared by introducing into an amber glass bottle 50 wt % of the compound 2 described above, and about 50 wt % Macrolon 5705®.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member comprising:

a substrate, a photo generating layer, and an optional overcoating layer wherein the photo generating layer comprises a cyclic triphenylamine material, and wherein the cyclic triphenylamine material comprises cyclic triphenylamine dimers having the following formulas (4), (5), and (6):

(4)

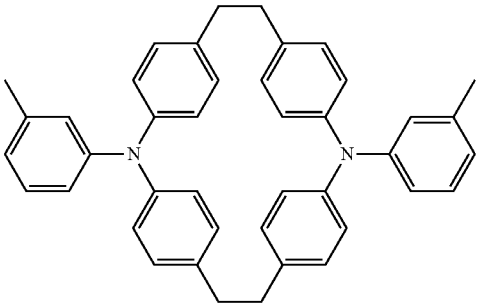

(5)

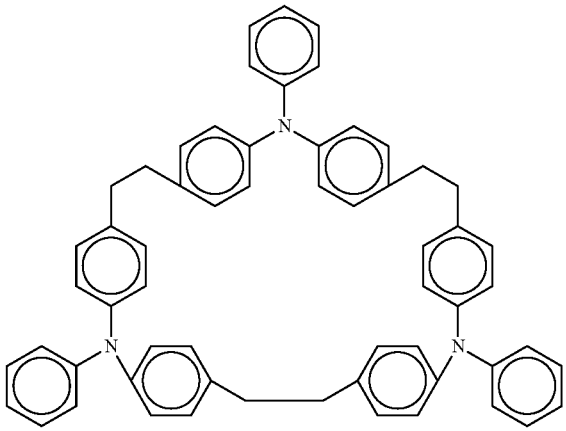

(6)

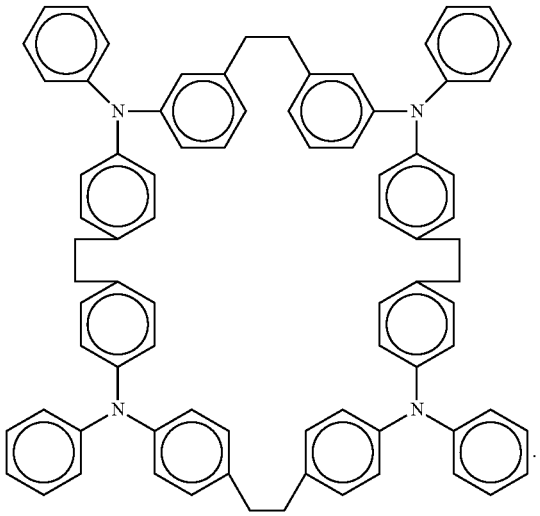

2. The electrophotographic imaging member of claim 1, wherein the photo generating layer comprises a charge generating layer and a separate charge transport layer, and the charge transport layer comprises the cyclic triphenylamine material.

3. The electrophotographic imaging member of claim 1, wherein the cyclic triphenylamine material is electrically conducting.

4. The electrophotographic imaging member of claim 1, wherein the photo generating layer comprising the cyclic triphenylamine material is essentially free of other charge transport materials.

5. The electrophotographic imaging member of claim 1, wherein the substrate is selected from the group consisting of a layer of electrically-conductive material or a layer of electrically non-conductive material having a surface layer of electrically-conductive material.

6. The electrophotographic imaging member of claim 1, wherein the substrate is in a form of an endless flexible belt, a web, a rigid cylinder, or a sheet.

7. The electrophotographic imaging member of claim 1, further comprising at least one of a hole blocking layer and an adhesive layer, between the substrate and the photo generating layer.

8. The electrophotographic imaging member of claim 1, wherein the charge generating layer comprises a film-forming binder and a charge generating material.

9. The electrophotographic imaging member of claim 1, wherein the photo generating layer further comprises a film-forming binder selected from the group consisting of polycarbonates, polyesters, polyamides, polyurethanes, polystyrenes, polyarylethers, polyarylsulfones, polybutadianes, polysulfones, polyethersulfones, polyethylenes, polypropylenes, polyimides, polymethylpentenes, polyphenylene sulfides, polyvinylacetate, polysiloxanes, polyacrylates, polyvinylacetals, polyamides, polyimides, amino resins, phenylene oxide resins, terephathalic acid resins, phenoxy resins, epoxy resins, phenylic resins, polystyrene and acrylonitrile copolymers, polyvinyl chloride, vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, polyvinylcarbazole, and mixtures thereof.

10. The electrophotographic imaging member of claim 1, wherein the cyclic triphenylamine material is molecularly dispersed in the photo generating layer.

11. A process for forming an electrophotographic imaging member comprising:

providing an electrophotographic imaging member substrate, and applying a photo generating layer over the substrate, wherein the photo generating layer comprises a cyclic triphenylamine material, and wherein the cyclic triphenylamine material comprises cyclic triphenylamine dimers having the following formulas (4), (5), and (6):

(4)

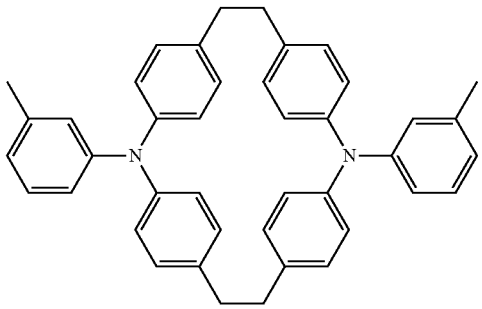

-continued (5)

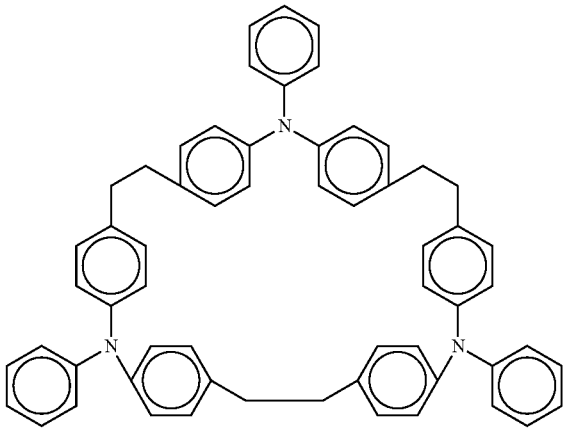

(6)

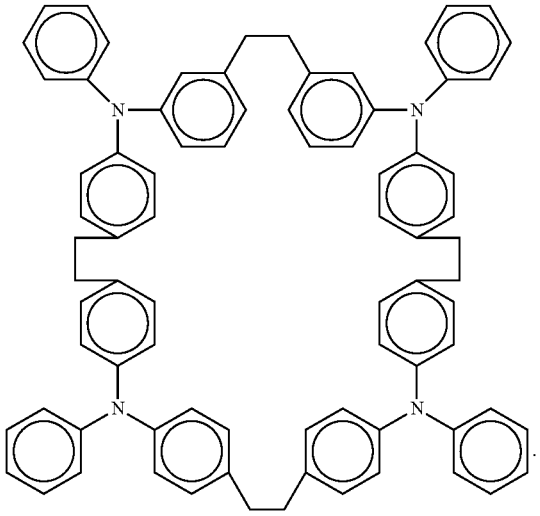

12. The process of claim 11, wherein the applying comprises:

applying a charge generating layer over the substrate, and applying a charge transport layer over the charge generating layer, wherein the charge transport layer further comprises the cyclic triphenylamine material.

13. The process of claim 12, wherein the applying the charge transport layer comprises applying a charge transport layer coating solution comprising a film-forming binder and the cyclic triphenylamine material to the substrate; and curing the charge transport layer coating solution to form the charge transport layer.

14. The process of claim 13, wherein the cyclic triphenylamine material is soluble in the charge transport layer coating solution.

15. An electrographic image development device, comprising an electrophotographic imaging member comprising:

a substrate, a photo generating layer, and an optional overcoating layer, wherein the photo generating layer comprises a cyclic triphenylamine material, and wherein the cyclic triphenylamine material comprises cyclic triphenylamine dimers having the following formulas (4), (5), and (6):

(4)

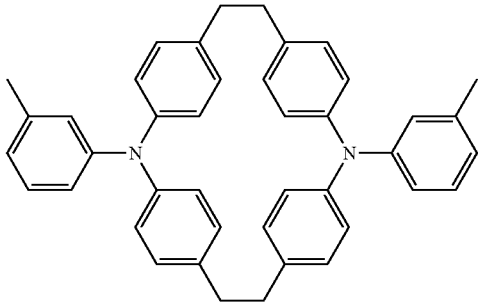

(5)

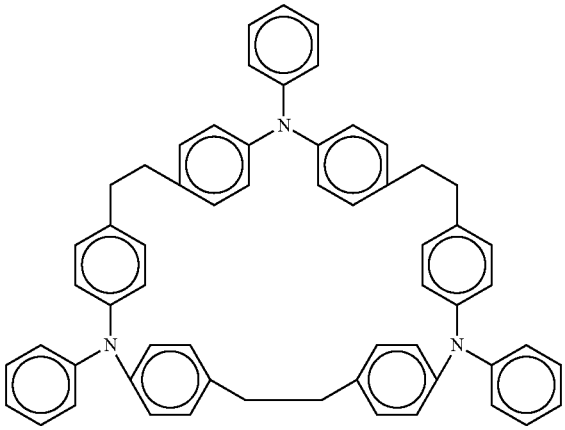

(6)

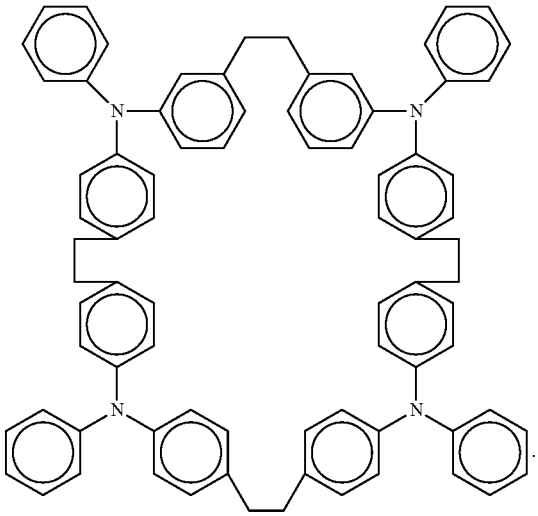

* * * * *